US005882475A

United States Patent [19]

Vikio et al.

[11] Patent Number: 5,882,475

[45] Date of Patent: Mar. 16, 1999

[54] METHOD OF RECOVERING FIBERS FROM A REJECT STREAM GENERATED IN A WASTEPAPER TREATING PROCESS

[75] Inventors: Pentti A. Vikio, Anjalankoski, Finland; Andrew J. Kovacs, Duluth, Ga.

[73] Assignee: Ahlstrom Machinery Inc., Glens Falls, N.Y.

[21] Appl. No.: 825,024

[22] Filed: Mar. 26, 1997

[51] Int. Cl.[6] ..... D21B 1/08

[52] U.S. Cl. ..... 162/4; 162/55

[58] Field of Search ..... 162/4, 55; 209/728, 209/729, 3, 17

[56] References Cited

U.S. PATENT DOCUMENTS

| | | | |
|---|---|---|---|
| 4,134,827 | 1/1979 | Frykhult | 209/211 |
| 5,069,751 | 12/1991 | Chamblee et al. | 209/170 |
| 5,131,980 | 7/1992 | Chamblee et al. | 162/4 |
| 5,529,190 | 6/1996 | Carlton et al. | 162/4 |

FOREIGN PATENT DOCUMENTS

WO 95/04189 2/1995 WIPO .

*Primary Examiner*—Stanley S. Silverman
*Assistant Examiner*—Dean T. Nguyen
*Attorney, Agent, or Firm*—Nixon & Vanderhye P.C.

[57] ABSTRACT

Rejects from a conventional first set of cleaners from a system feeding recycled cellulosic fiber slurry to a paper machine or rejects from the paper machine approach system cleaners are fractionated to produce a first, fine fraction, stream and a second, coarse fraction, stream containing most of the fiber and larger solids. The second stream is acted upon by a disperser, deflaker, or like mechanical agitating device, to disrupt the fiber flocs and reduce the size of solids to produce a third stream containing few or no fiber flocs and no large particles. The third stream may be diluted and cleaned in a second set of cleaners, and then is returned to the first set of cleaners (e.g. to the inlet of the first stage or between the first and second stages). Ink, and other fine undesirable particles may be removed from the first stream via flotation or cleaning, and the cleaned stream may also be returned to the first set of cleaners if desired.

20 Claims, 2 Drawing Sheets

10
PAPER MACHINE STOCK PREPARATION
12
32
11
13
14
15
16
I
II
III
IV
V
VI
20
20'
31
31,49
49
30
DISPOSAL
TO 50
CONTAMINANT FRACTIONATION AND DISPERSING SYSTEM
50

METHOD OF RECOVERING FIBERS FROM A REJECT STREAM GENERATED IN A WASTEPAPER TREATING PROCESS

BACKGROUND AND SUMMARY OF THE INVENTION

The present invention provides a method and apparatus for treating a slurry of comminuted cellulosic fibrous material to remove undesirable material prior to introducing the slurry to a paper machine while minimizing fiber loss. This invention is particularly applicable to the treatment of fibrous slurries produced from recycled paper, especially pre- and post-consumer recycled papers containing undesirable ink and ash particles.

In normal practice, prior to introducing a slurry of cellulosic fibrous material to a paper machine the virgin or recycled pulp slurry must be—among other things—treated to remove contaminants and introduce brightening and conditioning agents. These treatments and processes are typically performed in the pulp mill. After the stock is prepared it is transferred to the paper machine stock processing and preparation system. The processing and preparation system receives its fiber furnish either from an adjacent integrated pulp mill, from a pulp purchased from a market pulp supplier, or from a recycled pulp mill. Typically, the fiber is introduced as a slurry of fiber and liquid from an adjacent pulp mill or is processed from bales of virgin or recycled pulp that must first be re-pulped to produce an aqueous slurry. Typically, conventional stock processing and preparation includes repulsing or thickening and various cleaning, screening, and refining equipment with which the pulp slurry is treated.

Recent environmental concerns about conserving our forest resources has led to both public demand and legislative mandates requiring that more recycled pulp be used in the manufacture of paper, especially in the manufacture of newsprint. Many states now require that newsprint contain at least 15% post-consumer recycled pulp, or higher. For example, as of 1999 the state of California requires that newsprint contain a minimum of at least 50% post consumer recycled pulp. This introduction of recycled pulp to the paper machine increases the load upon the paper machine stock preparation and approach system for removing undesirable contaminants from the furnish. The increased content of ink, stickies, dirt, and other contaminants in the recycled pulp should be removed as efficiently as possible prior to the paper machine, where it can cause runnability problems, efficiency reduction, a loss in brightness, a loss in strength of the resulting paper, and negatively affect the drainability of the slurry on the paper machine itself. Though typically some of these contaminants are removed during stock processing and preparation, some contaminants are passed to the paper machine approach system and cause operating problems and increased fiber loss in the approach system.

In conventional paper machine approach systems, the slurry of fibers is typically cleaned and screened to produce a rejects stream containing oversized particles, pin chips, sand, ink particles and other undesirable debris, and some fiber. This reject stream of undesirable material is typically discarded as unusable.

In many existing systems, rejects from the last cleaning system(s) are taken to the effluent treatment for an associated mill or related installation. In some cases, part of the rejects (or even all of the rejects) are returned to the beginning of the process without any treatment. This then makes a closed loop for undesired solids and contaminants.

In the most recent systems, the last stage of the cleaning system includes a fiber saving device, such as a FIBERMIZER device sold by Celleco, which doesn't change the physical properties of the solids but just have lower separation efficiencies and so concentrates or increases the contaminants in the cleaning process circulation, and in that way reduces fiber losses.

In all the above-described conventional existing technologies the reduction of the losses is done by throttling the reject flow. When the reject outlet flow is throttled, the separation efficiency of the undesired contaminants is also reduced and the only way for these solids is to go into the accepts, and thus the risk of runnability and quality problems is increased. In this invention, this fiber-containing stream is treated to recover the useable fiber. The present invention provides a method and apparatus for minimizing or removing these undesirable contaminants from the stock flow, typically as an adjunct to a conventional approach system, while minimizing the loss of valuable fiber. This is achieved by mechanically agitating the flow of rejected material to reduce pin chip and fiber flocs so that they can be recovered and reused. Though mechanical dispersion or deflaking is common in conventional recycled-fiber treatment, typically only the screening and cleaning accept flow is mechanically treated to improve ink dispersion and for deflaking. The screening and cleaning reject flow is typically untreated and discarded.

According to one aspect of the present invention a method of removing ink and other fine undesirable particles from a slurry comminuted cellulosic fibrous material, containing ink particles and larger contaminants (preferably a slurry containing at least 15% post-consumer recycled pulp, at a consistency of between about 0.5–4.5%, preferably between about 2.5–3.5% by weight, e.g. containing at least 50% post-consumer recycled pulp) which is being fed to a paper machine using a first set of cleaners, is provided. The method comprises the following steps: (a) Cleaning the slurry in the first set of cleaners to produce at least one reject stream containing the majority of the undesirable contaminants including ink particles, and at least one accept stream containing fewer contaminants than the at least one reject stream. (b) Fractionating at least one reject stream to produce a first, fine fraction, stream containing the majority of the ink and other fine undesirable particles, and a second, coarse fraction, stream containing most of the fiber and larger contaminants. (c) Mechanically agitating the second, coarse fraction, stream to disrupt fiber flocs and reduce the size of contaminants to create a third stream containing few or no fiber flocs and no large particles. (d) Returning the third stream containing fiber but few or no ink particles, fiber flocs, or large contaminates, to the first set of cleaners. And, (e) feeding a cleaned stream of slurry from the first set of cleaners to a paper machine.

The first set of cleaners preferably comprises at least three stages of vortex cleaners and step (d) may be practiced by returning the third stream to before the second cleaning stage but upstream of where the reject stream is passed to fractionation. There may be the further steps of removing ink particles from the first stream via flotation or cleaning to produce a fourth stream, and returning the fourth stream to the first set of cleaners, e.g. upstream of where the reject steam is passed to fractionation. Step (b) may be practiced by passing the slurry through screens having slots between 0.001–0.020 inches in width, preferably between 0.006–0.010 inches.

In a preferred embodiment there is an additional step in which the ink-laden first fine-fraction of step (b) is further treated to remove ink particles. This step may comprise flotation [for example, dissolved-air flotation, or micro-flotation], or GSC® Hydrocyclone flotation as sold by Ahlstrom Machinery, and described in U.S. Pat. Nos. 5,069,751; 5,131,980, or 5,529,190. Another embodiment includes a further cleaning step (f), between steps (c) and (d), in which the third stream is cleaned prior to return to the first set of cleaners, and a diluting step (g) between steps (c) and (f).

The mechanical agitating device used in the practice of step (c) is, for example, a dispersing device, such as an MDR® disperser as sold by Ahlstrom Machinery, or a deflaking device, such as a deflaker-type pump, or any similar device which agitates the slurry to disrupt fiber flocs and reduce contaminant size and improve contaminant distribution.

In another embodiment of the invention, the first set of cleaners in step (a) includes at least three stages of cleaners, and step (d) is practiced by introducing the third or second stream downstream of the first or second cleaner stage.

According to another aspect of the present invention a system for producing cleaned comminuted cellulosic fibrous material slurry is provided. The system comprises the following components: A first set of cleaners for separating ink particles from a slurry of comminuted cellulosic fibrous material, including a plurality of cleaning stages, at least one inlet, and at least one rejects outlet. A fractionating device having an inlet connected to the at least one rejects outlet from the first set of cleaners, a first, fine fraction, outlet, and a second, coarse fraction, outlet. A mechanical device having an inlet connected to the second outlet for disrupting fiber flocs and reducing the size of contaminants, and having an outlet. And, the mechanical device outlet connected to the at least one inlet of the first set of cleaners.

In a preferred embodiment of this invention, the first set of cleaners includes of at least four stages of cleaning. In another embodiment, the first and second set of cleaners are vortex cleaners, for example RB 200 cleaners as sold by Ahlstrom Machinery of Glens Falls, N.Y. The fractionating device is preferably a static bow screen or a rotary pressure screen, for example a Micra-Screen™ or Ahldecker™ screen as sold by Ahlstrom Machinery.

Another embodiment includes a flotation device for further removing ink particles from the fine-fraction discharged from the fractionating device. The flotation device is preferably a micro-flotation device, a dissolved-air flotation device, or a GSC® Hydrocyclone with or with out a separation vessel.

A further embodiment of this invention includes a second set of cleaners located downstream of the agitation device for cleaning the slurry prior to returning it to the first set of cleaners, and a dilution tank before the second set of cleaners. The mechanical (agitating) device is preferably the device described above.

According to another aspect of the present invention a paper machine stock preparation system is provided comprising the following components: An approach system to a paper machine. A first set of cleaners for separating ink particles from a slurry of comminuted cellulosic fibrous material, including a plurality of cleaning stages, at least one inlet, a cleaned slurry outlet, and at least one rejects outlet. The cleaned slurry outlet connected to the approach system of a paper machine. A fractionating device having an inlet connected to the at least one rejects outlet from the first set of cleaners, a first, fine fraction, outlet, and a second, coarse fraction, outlet. A mechanical device having an inlet connected to the second outlet for disrupting fiber flocs and reducing the size of contaminants, and having an outlet. And, the mechanical device outlet connected to the at least one inlet of the first set of cleaners.

The details of the components of the paper machine system are preferably as described above for the system for producing claimed slurry. Throughout the practice of the invention the slurry preferably has a consistency of between about 0.1–3.0%, preferably between about 0.5–1.0%, by weight.

It is the primary object of the present invention to provide maximum fiber recovery while even more effectively cleaning a slurry fed to the approach system of a paper machine. This and other objects of the invention will become clear from an inspection of the detailed description of the invention and from the appended claims.

DETAILED DESCRIPTION OF THE DRAWINGS

Figure 1:
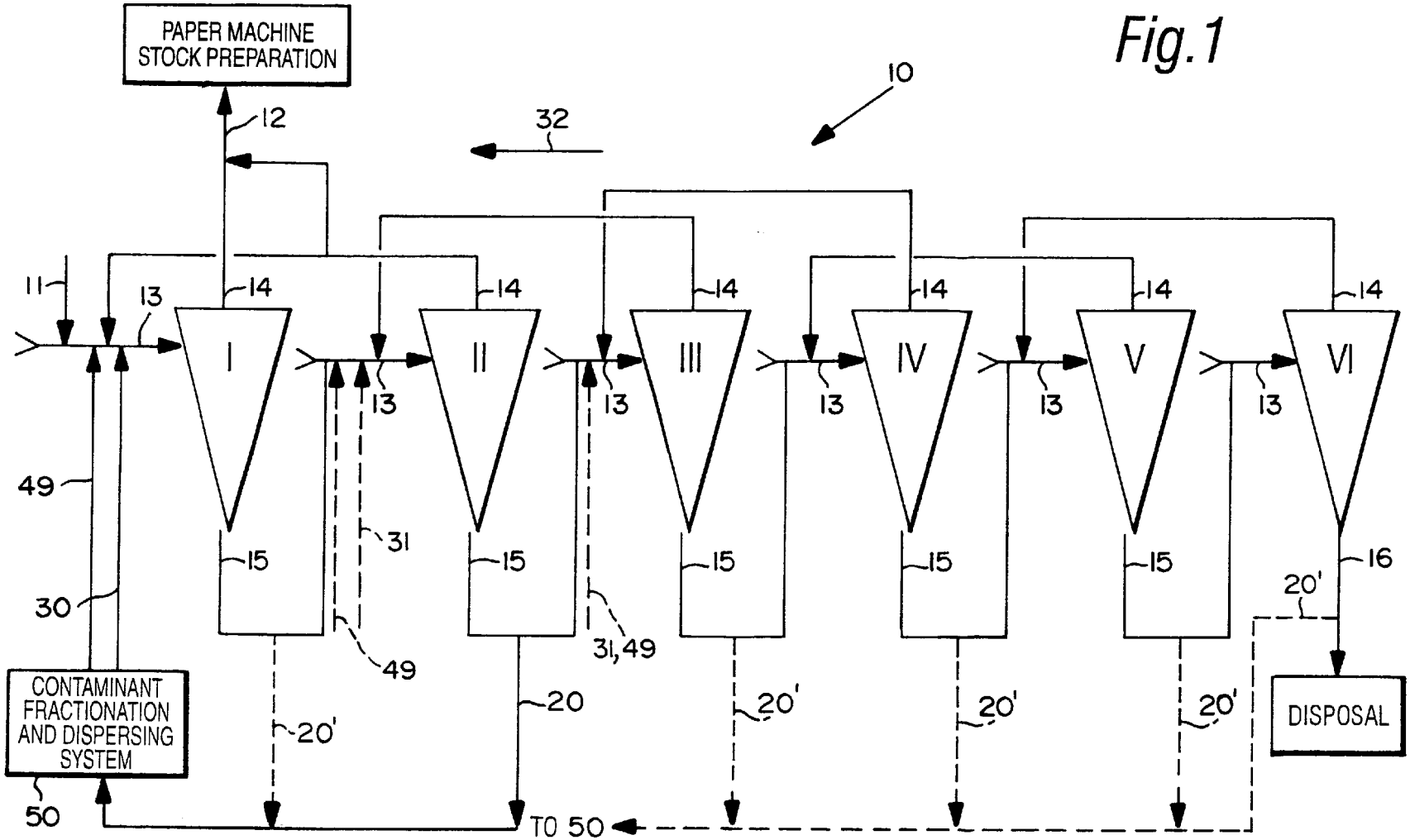
FIG. 1 is a schematic representation of an exemplary conventional system of cleaners that are shown in conjunction with the system of the invention.

FIG. 1 is a schematic illustration of a typical system 10 of cleaning stages in a conventional paper machine approach system or in the recycled pulp mill. The system 10 may comprise six stages of cleaners, I through VI, and each stage may comprise one or more cleaners, for example, vortex cleaners such as the RB 200 cleaner sold by Ahlstrom Machinery of Glens Falls, N.Y. The system 10 includes an inlet 11 into which is introduced a slurry of comminuted cellulosic fibrous material, for example softwood fibers or recycled fibers (e.g. at least about 15% post-consumer waste recycled fibers, e.g. at least about 50%), at a consistency of between about 0.5 and 4.5%, preferably between about 1.5 to 3.0%, by weight.

Each cleaner stage I–VI of system 10 includes one or more inlets 13, one or more accepts outlets 14, and one or more rejects outlets 15. The accepts outlet 14 from one stage (e.g. II) is typically connected to the inlet 13 of the preceding stage (e.g. I). The rejects outlet 15 from one stage (e.g. II) is typically connected to the inlet 13 of the following stage (e.g. III). The cleaned slurry is discharged through conduit 12 to a paper machine or to the paper machine stock preparation system. The last rejects outlet 16 from cleaner stage VI, for example, is typically discharged to disposal or, if necessary, further processing.

Figure 2:
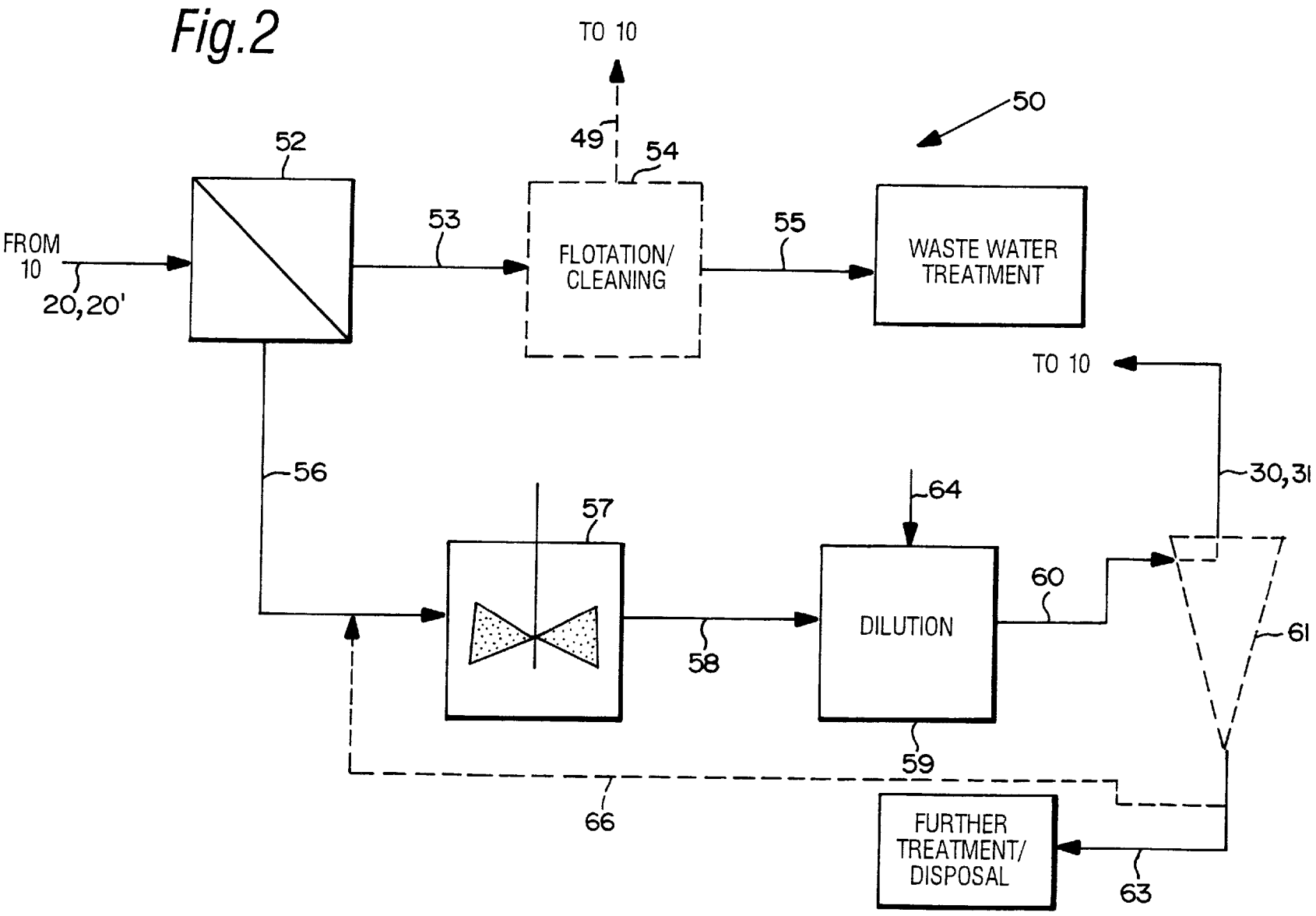
FIG. 2 is a schematic representation of one embodiment of an exemplary system according to the invention.

According to the invention, one of the rejects outlet conduits 15 is connected to a conduit 20, for example, for passing the rejected flow to the system of the present invention illustrated in FIG. 2. Conduit 20 typically contains rejected slurry containing fibers, filler particles, ink-particles, and other contaminants, such as stickies and dirt, among other things. Though it is preferred that the rejected slurry be removed from cleaning stage II, the rejected slurry may be removed from any other cleaning stage I–VI outlets via conduits 20'. In any event the withdrawn slurry passes to the contaminant fractionation and dispersing system 50 of the invention.

The slurry cleaned according to the system 50 of the invention is re-introduced to one or more cleaner stage inlets of system 10, for example, to the inlet of stage I via conduit 30. The treated slurry may also re-introduced to the inlet of any other cleaner stage, for example via conduit 31, and is preferably introduced upstream (in the direction of flow 32) of the outlet 20.

FIG. 2 illustrates one preferred embodiment of the system 50 of the present invention. The contaminant-laden slurry removed from system 10 (FIG. 1) is introduced to fractionator 52 via one or more conduits 20, 20'. Fractionator 52 may be a rotary pressure screen, a bow screen, or any other conventional fractionating screening device. Fractionator 52 is preferably a slotted pressure screen, such as an Ahldecker™ pressure screen or a static bow screen such as a Micra-Screen™ as sold by Ahlstrom Machinery. Typically the screen 52 will have slots from about 0.001 to 0.020 inches in width, preferably 0.006 to 0.010 inches in width.

Fractionator 52 divides the slurry flow into a fine fraction stream 53 and a coarse traction stream 56. The fine fraction stream 53 typically contains fine contaminants and ink. For example, stream 53 preferably contains most of the ink and other fine undesirable particles introduced in conduit(s) 20, 20', plus fines and small filler particles, among other things, which are typically smaller than 100 microns. Optionally this stream may be further treated in device 54, for example via flotation or cleaning, to further isolate the ink particles. The flotation at 54 may comprise micro-flotation or flotation in a vortex flotation system, such as a GSC® flotation system as sold by Ahlstrom Machinery. If the device 54 is a cleaning device it may be a reverse vortex cleaner, or other suitable conventional cleaner, which may include, or be without, chemical treatment of the flow is to have the ink particles as larger agglomerates as described in U.S. Pat. No. 5,587,078. Stream 53 may alternatively be sent directly to waste water treatment, or from flotation or cleaning device 54 the slurry at 55 is sent to waste water treatment. The cleaned portion (a fourth stream) of the stream 53 from device 54 may be passed in line 49 back to system 10 to any position or divided illustrated in FIG. 1.

The coarse fraction stream 56 typically contains valuable fiber, large filler agglomerates, and large debris having a typical size of 100 microns or larger. Preferably, the reject stream 56 is agitated or dispersed in conventional agitating/dispersing device 57 which exposes the stream to strong shearing forces which mechanically reduce the size of the particles or contaminants and disrupt fiber flocs in the stream. The device 57 may be a disperser (e.g. an MDR® disperser), a deflaker (e.g. a deflaking pump) or like conventional device.

After agitation in device 57, the stream may be passed via conduit 58 to storage vessel 59. The rejects stream 56 is typically diluted, for example, by dilution 64 in vessel 59. The source of dilution 64 may typically be white water from the paper machine, or any other source of clean filtrate. The slurry may be fed by conduit 60 to be further treated in cleaner or cleaners 61. The optional one or more cleaners 61 (e.g. vortex cleaners) remove dense contaminants which are discharged at 63 to further treatment or disposal, or returned via line 66. The cleaned accept flow, for example the accepts discharged from cleaner 61, or the line 60 per se, contain valuable fiber and little or no ink, ash or debris. The accepts pass via conduit 30, 31 back to the initial cleaning system 10 of FIG. 1, for re-introduction to the system feeding the paper machine. While conduit 30 preferably introduces the cleaner flow as illustrated in FIG. 1, it may be introduced anywhere upstream of the discharge 20 (or 20'), e.g, see conduit 31.

As described above, the proposed invention improves existing stock approach systems for paper machines by providing for the reduction of contaminants while minimizing the loss of valuable fiber. The invention is especially applicable to fiber slurries produced from recycled papers. Recycled pulp (especially made from post-consumer paper) is especially prone to contain undesirable ink and ash particles, as well as other contaminants, which can effectively be removed according to the present invention.

While the invention has been described in connection with what is presently considered to be the most practical and preferred embodiment, it is to be understood that the invention is not to be limited to the disclosed embodiment, but on the contrary, is intended to cover various modifications and equivalent arrangements and methods included within the spirit and scope of the appended claims.

What is claimed is:

1. A method of removing ink and other fine undesirable particles from a slurry of comminuted cellulosic fibrous material, containing ink particles and larger contaminants, which is being fed to a paper machine, using a first set of cleaners, comprising the steps of:

(a) cleaning the slurry in the first set of cleaners to produce at least one reject stream containing the majority of the undesirable contaminants including ink particles, and at least one accept stream containing fewer contaminants than the at least one reject stream;

(b) fractionating at least one reject stream to produce a first, fine fraction, stream containing the majority of the ink and other fine undesirable particles, and a second, coarse fraction, stream containing most of the fiber and larger contaminants;

(c) mechanically agitating the second, coarse fraction, stream to disrupt fiber flocs and reduce the size of contaminants to create a third stream containing few or no fiber flocs and few or no large particles;

(d) returning the third stream containing fiber but few or no ink particles, fiber flocs, or large contaminates, to the first set of cleaners, to recover usable fiber; and (e) feeding a cleaned stream of slurry from the first set of cleaners to a paper machine.

2. A method as recited in claim 1 comprising the further step of removing ink and other fine undesirable particles from the first stream via flotation or cleaning.

3. A method as recited in claim 1 comprising the further step (f), between steps (c) and (d), of cleaning the third stream.

4. A method as recited in claim 3 comprising the further step (g), between steps (c) and (f), of diluting the third stream.

5. A method as recited in claim 3 wherein the slurry utilized in the practice of step (a) is a slurry containing at least about 50% post consumer recycled pulp fiber.

6. A method as recited in claim 1 wherein the first set of cleaners comprises at least three stages of vortex cleaners; and wherein step (d) is practiced by returning the third stream to before the first cleaning stage.

7. A method as recited in claim 6 comprising the further steps of removing ink particles from the first stream via flotation or cleaning to produce a fourth stream, and returning the fourth stream to the first set of cleaners.

8. A method as recited in claim 6 comprising the further step (f), between steps (c) and (d), of cleaning the third stream.

9. A method as recited in claim 8 comprising the further step (g), between steps (c) and (f), of diluting the third stream.

10. A method as recited in claim 6 wherein the slurry utilized in the practice of step (a) is a slurry containing at least about 50% post consumer recycled pulp fiber, at a consistency of between about 0.5–4.5%.

11. A method as recited in claim 6 wherein step (c) is practiced by acting on the second, coarse fraction in a disperser.

12. A method as recited in claim 6 wherein step (c) is practiced by acting on the second, coarse fraction in a deflaker.

13. A method as recited in claim 1 wherein the first set of cleaners comprises at least three stages of cleaners; and wherein step (d) is practiced by returning the third stream to before the second cleaning stage but upstream of where the reject stream is passed to fractionation.

14. A method as recited in claim 13 comprising the further steps of removing ink particles from the first stream via flotation or cleaning to produce a fourth stream, and returning the fourth stream to the set of cleaners upstream of where the reject stream is passed to fractionation.

15. A method as recited in claim 13 wherein the slurry utilized in the practice of step (a) is a slurry containing at least about 50% post consumer recycled pulp fiber, at a consistency of between about 0.5–4.5%.

16. A method as recited in claim 13 wherein step (c) is practiced by acting on the second, coarse fraction with a disperser or a deflaker.

17. A method as recited in claim 1 wherein step (b) is practiced by passing the slurry through one or more screens having slots between 0.006–0.010 inches in width.

18. A method as recited in claim 1 wherein the slurry utilized in the practice of step (a) is a slurry containing at least 15% post consumer recycled pulp fiber, at a consistency of between about 0.5–4.5%.

19. A method as recited in claim 1 wherein step (c) is practiced by acting on the second, coarse fraction in a disperser.

20. A method as recited in claim 1 wherein step (c) is practiced by acting on the second, coarse fraction in a deflaker.

* * * * *